US005538648A

United States Patent [19]

Bücheler et al.

[11] Patent Number: 5,538,648

[45] Date of Patent: Jul. 23, 1996

[54] PROCESS FOR PRETREATING A TEXTILE MATERIAL

[75] Inventors: Dominik Bücheler, Muttenz; Saverio Fornelli, Basel, both of Switzerland

[73] Assignee: Sandoz Ltd., Basel, Switzerland

[21] Appl. No.: 466,492

[22] Filed: Jun. 6, 1995

Related U.S. Application Data

[63] Continuation of Ser. No. 128,445, Sep. 28, 1993, abandoned, which is a continuation of Ser. No. 853,455, Mar. 18, 1992, abandoned.

[30] Foreign Application Priority Data

Mar. 20, 1991 [DE] Germany ..... 41 09 084.5

[51] Int. Cl.[6] ..... D06M 13/00

[52] U.S. Cl. ..... 8/111; 8/138; 8/139; 8/125; 510/337; 510/361

[58] Field of Search ..... 252/8.6, 142, 174.24; 8/138, 139

[56] References Cited

U.S. PATENT DOCUMENTS

| | | | |
|---|---|---|---|
| 3,644,204 | 2/1972 | Heins | 252/8.8 |
| 4,000,083 | 12/1976 | Heesen | 252/135 |
| 4,163,732 | 8/1979 | Sai | 252/99 |
| 4,255,148 | 3/1981 | Reinwald | 8/137 |
| 4,388,205 | 6/1983 | Stettler | 252/135 |
| 4,559,150 | 12/1985 | Becker | 252/8.6 |
| 4,655,955 | 4/1987 | Jetcheva | 252/105 |
| 4,842,769 | 6/1989 | Shulman | 252/8.6 |
| 4,880,566 | 11/1989 | Baehr | 252/389.22 |
| 4,912,056 | 3/1990 | Olson | 435/263 |
| 4,933,096 | 6/1990 | Demeyere | 252/8.8 |
| 4,959,075 | 9/1990 | Baehr | 8/111 |
| 4,999,121 | 3/1991 | De Block | 252/8.8 |

FOREIGN PATENT DOCUMENTS

| | | |
|---|---|---|
| 076166 | 4/1983 | European Pat. Off. . |
| 233350 | 8/1987 | European Pat. Off. . |
| 313144 | 4/1989 | European Pat. Off. . |
| 382183 | 8/1990 | European Pat. Off. . |
| 2587354 | 3/1987 | France . |
| 2543946 | 4/1976 | Germany . |
| 2554360 | 6/1977 | Germany . |
| 3601672 | 8/1986 | Germany . |
| 3545909 | 6/1987 | Germany . |
| 3805880 | 9/1989 | Germany . |
| 56-5080 | 1/1920 | Japan . |
| 440564 | of 1935 | United Kingdom . |
| 926308 | of 1963 | United Kingdom . |
| WO90/01535 | 2/1990 | WIPO . |

OTHER PUBLICATIONS

Z. B. Chwala, Handbuch 1977 pp. 1008–1010.

"Pretreatment", S. Fornelli, Sandoz Products Bulletin, pp. 1–30 Jan. 1990.

*Primary Examiner*—Paul Lieberman
*Assistant Examiner*—Michael P. Tierney
*Attorney, Agent, or Firm*—Robert S. Honor; Carl W. Battle; Hesna J. Pfeiffer

[57] ABSTRACT

A process for improving the removal of undesired substances from a cellulosic textile material comprising i) treating the textile material with an aqueous solution comprising a) citric acid, b) an alkali metal or ammonium salt of a gluconic acid, and c) optionally a mineral acid (preferably in a minor amount).

18 Claims, No Drawings

PROCESS FOR PRETREATING A TEXTILE MATERIAL

This is a continuation of application Ser. No. 08/128,445, filed Sep. 28, 1993 now abandoned, which in turn is a continuation of application Ser. No. 07/853,455, filed Mar. 18, 1992, now abandoned.

Natural textile fiber material, in particular cellulosic fiber material (especially cotton, but also wool and silk) can be processed to form filaments, yarns and threads which can be used to make fabrics and knitted goods.

This process usually requires a pretreatment. For example cellulose fiber material can be desized, bleached, caustifised or mercerized, in such a way that undesirables such as metals like copper and iron ions or salts and/or hydroxides, such as those of magnesium or calcium are removed. Colored and sticky substances can also be so removed. The natural color associated with cellulose can be removed by bleaching (for example with hydrogen peroxide). Caustifisation and mercerization can be carried out using alkali metal solutions, and optionally alkali metal silicates.

According to the invention there is provided a pretreatment process especially for improving the removal of undesired substances from a cellulosic textile material comprising i) treating the textile material with an aqueous solution comprising a) citric acid (or an alkali metal citrate), b) an alkali metal or ammonium salt of a gluconic acid, and optionally c) a mineral acid (preferably in a minor amount).

In this Specification, reference to citric acid includes reference to alkali metal citrates depending on the pH of the composition.

This treatment may be carried out prior to, after or at the same time as ii) treating the material with a desizing agent, a caustifising agent, a mercerizing agent or a bleaching agent.

The minor amount of mineral acid is advantageouly added to increase the concentation of the protons in the composition. When it is used in the alkaline region, the alkali is necesssary for neutralising the acid, and is of minor importance.

Further according to the invention there is provided an aqueous solution of a) citric acid (or alkali metal citrate), b) an alkali metal or ammonium salt of a gluconic acid, and c) optionally a mineral acid (preferably in a minor amount).

Preferably the alkali metal or ammonium salt of gluconic acid present is sodium or potassium gluconate, more preferably sodium gluconate.

Preferably the mineral acid is hydrochloric acid or sulfuric acid, more preferably hydrochloric acid (especially dilute (eg about 30%) hydrochloric acid).

Preferably the amount of citric acid (or citrate) present is from 5–40%, more preferably 15–30% most preferably 25% by weight.

Preferably the amount of gluconic acid salt present is 5–40% by weight, more preferably 15–30%, most preferably 25% by weight.

Preferably the amount of mineral acid present is 0–10%, more preferably 1 to 8%, most preferably 5% by weight (the percentages being based on 100% acid).

Preferably a composition according to the invention comprises a) 5–40%, (more preferably 15–30) citric acid (or alkali metal citrate), b) 5–40%, (more preferably 15–30) sodium gluconate and c) 0–10% (more preferably 1–5) hydrochloric acid (preferably added as a 30% solution), the balance to 100% being water (more preferably 45% water).

Preferably in a pretreatment process according to the invention, up to 100 ml/l, more preferably 1–50 ml/l, especially 1–20 ml/l is employed.

Preferably the citric acid (or alkali metal citrate) and gluconate salt are present in approximately equal amounts.

One preferred composition (hereinafter composition 1) according to the invention comprises a) 25% citric acid (or alkali metal citrate)

b) 25% sodium gluconate c) 5% hydrochloric acid, and d) 45% water

Another preferred composition (hereinafter composition 2) according to the invention comprises a) 15% citric acid (or alkali metal citrate)

b) 15% sodium gluconate, and c) 3.2% hydrochloric acid.

A further preferred composition (hereinafter Composition 3) according to the invention comprises:

a) 30% citric acid b) 30% sodium gluconate and c) 1% hydrochloric acid.

It has been found that the composition according to the invention can be useful over the full range of pH with the following effects:

pH 2.0 to 3.0: for the ionization of heavy metals, which can then be eliminated in a soluble form;

pH 3.0 to 4.0: for demineralizing natural fibers (heavy metals or alkali earth metals);

pH 4.0 to 5.0: for removing size and pigment residues from synthetic and natural material;

pH 5.0 to 8.0: under a buffer system, enzymatic treatment can occur;

pH 8.0 to 11.0: complex formation occurs with any heavy metals present as well as stabilization of hydrogen peroxide liquors; and pH 11.0 to 13.0 for alkali neutralization. The addition of the mixture according to the invention can occur prior to acid after treatment with caustifisation, mercerization or bleaching.

Preferably soda is added to a composition according to the invention to bring the pH to the required value.

In this Specification, all percentages are by weight.

The invention will now be illustrated by the following examples in which all parts and percentages are by weight and all temperatures are in °C. unless indicated to the contrary.

EXAMPLE 1

An untreated cotton fabric is padded at room temperature with a liquor containing, per liter of liquor, 2 g of a commercially available wetting agent (dispersing agent) known as Sandoclean PC liquid and 20 g of a composition (hereinafter defined as Composition a) comprising a) 25% citric acid, b) 25% sodium gluconate and c) 5% hydrochloric acid (30% solution), and d) 45% water.

This composition is at a pH of 2.8.

Impregnation occurs until the weight of the fabric increases 90% by liquor take up. The fabric is allowed to stand for four hours and then is washed intensively. By this method, the textile material is demineralized and is ready, optionally after drying, for further treatment.

EXAMPLE 2

In order to desize enzymatically (and stabilize the enzyme), an untreated cotton fabric is impregnated, in a pad batch process, with an aqueous liquor containing , per liter of liquor, 5 ml of a commercially available desizing agent based on a bacterial α- amylase (commercially available as Bactosol MTN liquid) and 1 ml of Composition a comprising a) 25% citric acid, b) 25% sodium gluconate and c) 5% hydrochloric acid (30% solution), and d) 45% water;

the pH of which is raised to 6 by the addition of soda. The fabric is allowed to stand for 10 hours. Washing and drying are then carried out conventionally and a perfectly desized material results. Jeans fabric may be scoured in a similar manner to clean it. In this case an aqueous liquor containing per liter of liquor, 10 ml of the above mentioned desizing agent and 2 ml of the composition 2, the pH being adjusted to 5.5 with soda rather than 6. The fabric is then treated in a tumbler for 40 minutes at 60°.

EXAMPLE 3

Untreated silk is enzymatically cleaned with an aqueous liquor (at goods to liquor ratio of 1:3) containing , per liter of liquor, 2 ml of a commercially available desizing agent based on protease and 1 ml of composition a (defined in Example 1) that has been brought to pH 8.5 by the addition of soda. The fabric is treated in a tumbler for 25 minutes at 60° and then rinsed and dried.

EXAMPLE 4

In order to complex $Fe^{3+}$ ions , an untreated fabric is treated at the boil with an aqueous liquor containing, per liter of liquor, 5 ml of a commercially available, alkali-stable, weakly foaming anionactive tenside (commercially available as Sandopan CBN liquid), 2 ml of composition a (defined in Example 1) and 50 g caustic soda in solid form. The fabric is impregnated until the weight of the fabric increases 100% by liquor take up. The fabric is then treated according to a Pad-Steam process at 102° for 10 minutes. The substrate is then washed, rinsed and dried.

EXAMPLE 5

An untreated cotton fabric is impregnated with an aqueous liquor containing, per liter, 5 ml of the anionically active wetting agent, Sandoclean PC liquid, 10 ml of a commercially available organic stabilizer (for the semi- and fully-continuous silicate free alkali hydrogen peroxide bleaching of cotton) commercially available as Stabilisator SIFA liquid, 2 ml of Composition 1, 40 ml of NaOH 36 Bé and 40 ml of hydrogen peroxide. Impregnation occurs until the weight of the fabric increases 100% by liquor take up according to a Pad -Steam process over 30 minutes at 102°. The fabric is then washed, rinsed and dried. The resulting fabric is perfectly bleached.

The washing step can be improved by adding, per liter of washing liquor, 5 ml of Composition a (defined in Example 1) in a washing machine, washing for 30 seconds at 60°, followed by rinsing and drying.

EXAMPLE 6

An untreated cotton fabric is treated with an aqueous liquor at goods to liquor ratio of 1:15, containing 5 ml/l of the Composition b which comprises a) 15% citric acid (or alkali metal citrate)

b) 15% sodium gluconate, and c) 3.2% hydrochloric acid; and d) 66.8% water;

and 2 ml of the commercially available wetting agent Sandoclean PC liquid and 5 g/l of a commercially available hydrosulfite bleaching agent (Arostit D BLN) at 60° C. This is then rinsed, once hot, once warm and once cold.

This method enables bleaching to be carried out avoiding the use of sodium hypochlorite and so is more environmentally friendly (i.e. avoids the use of chlorine).

Example 6 can be repeated using, instead of composition b, 2.5 mls of composition c comprising:

a) 30% citric acid b) 30% sodium gluconate and c) 1% hydrochloric acid;

and 2 ml of the commercially available wetting agent Sandoclean PC liquid and 5 g/l of a commercially available hydrosulfite bleaching agent (Arostit D BLN) at 60° C.

What is claimed is:

1. A textile pretreatment process for removing undesired substances from a untreated cellulosic untreated textile material occurring prior to or during a desizing step, a mercerizing step, a caustifying step, or a bleaching step comprising the process step of:

treating the untreated textile material with an aqueous solution comprising:

a) citric acid or an alkali metal citrate;

b) an alkali metal salt or an ammonium salt of a gluconic acid;

c) a mineral acid; and, d) optionally, soda, the solution being useful over a pH range of from about 2.0 to 13.0, wherein said process is followed by or occurs during a process step selected from a desizing step, a mercerizing step, a caustifying step, or a bleaching step.

2. A process according to claim 1 wherein the alkali metal salt or an ammonium salt of a gluconic acid is sodium or potassium gluconate.

3. A process according to claim 2 in which the alkali metal or ammonium salt of a gluconic acid is sodium gluconate.

4. A process according to claim 1 in which the mineral acid is hydrochloric acid or sulfuric acid.

5. A process according to claim 1 which comprises:

a) 5–40% by weight of citric acid.

6. A process according to claim 1 which comprises:

b) 5–40% by weight an alkali metal salt or an ammonium salt of a gluconic acid.

7. A process according to claim 1 wherein the mineral acid is present in an amount ranging from 1 to 5% by weight.

8. A process according to claim 1 in which the composition comprises:

a) 25% by weight of citric acid or an alkali metal citrate;

b) 25% by weight of an alkali metal salt or an ammonium salt of a gluconic acid; and, c) 5% by weight hydrochloric acid.

9. A process according to claim 1 in which the composition comprises:

a) 30% by weight of citric acid or an alkali metal citrate;

b) 30% by weight of an alkali metal salt or an ammonium salt of a gluconic acid; and, c) 1% by weight hydrochloric acid.

10. A process according to claim 1 in which the composition comprises:

a) 15% by weight of citric acid or an alkali metal citrate;

b) 15% by weight of an alkali metal salt or an ammonium salt of a gluconic acid; and, c) 3.2% by weight hydrochloric acid.

11. A textile pretreatment process according to claim 1 characterized in that:

the aqueous solution is at a pH from 2–13.

12. A textile pretreatment process according to claim 1 for the ionization of a heavy metals wherein the aqueous solution is at a pH of 2–3.

13. A textile pretreatment process according to claim 1 for the demineralization of a textile material wherein the aqueous solution is at a pH of 3–4.

14. A textile pretreatment process according to claim 1 for the removal of size or pigment residues from a textile material wherein the aqueous solution is at a pH of 4– 5.

15. A textile pretreatment process according to claim 1 for treatment with an enzymatic composition of a textile material wherein the aqueous solution is at a pH of 5–8.

16. A textile pretreatment process according to claim 1 the stabilization of a hydrogen peroxide liquor in contact with a textile material wherein the aqueous solution is at a pH of 5–8.

17. A textile pretreatment process according to claim 1 for formation of heavy metal complexes with a heavy metal present in a textile material wherein the aqueous solution is at a pH of 8–11.

18. A textile pretreatment process according to claim 1 for the acid neutralization of a textile material wherein the aqueous solution is at a pH of 11–13.

* * * * *